US012241337B2

(12) United States Patent
Wai et al.

(10) Patent No.: US 12,241,337 B2
(45) Date of Patent: Mar. 4, 2025

(54) METHOD FOR OPENING A COMPLETION ISOLATION VALVE WITH E-LINE POWERED SHIFTING TOOL

(71) Applicant: Halliburton Energy Services, Inc., Houston, TX (US)

(72) Inventors: Simon Whye Kwong Wai, Singapore (SG); Mark S. Holly, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 212 days.

(21) Appl. No.: 18/075,839

(22) Filed: Dec. 6, 2022

(65) Prior Publication Data

US 2024/0183248 A1 Jun. 6, 2024

(51) Int. Cl.
*E21B 34/14* (2006.01)
*E21B 23/01* (2006.01)
*E21B 47/00* (2012.01)

(52) U.S. Cl.
CPC ..... *E21B 34/14* (2013.01); *E21B 23/01* (2013.01); *E21B 47/00* (2013.01)

(58) Field of Classification Search
CPC ..... E21B 34/14
See application file for complete search history.

(56) References Cited

U.S. PATENT DOCUMENTS 3,910,352 A * 10/1975 Mott ..... E21B 33/1295 166/321
6,024,173 A * 2/2000 Patel ..... E21B 34/14 166/321
9,133,671 B2 9/2015 Kellner
2010/0258293 A1 10/2010 Lynde et al.
2013/0199795 A1 8/2013 Williamson et al.
2015/0176369 A1 6/2015 Nguyen et al.
(Continued)

FOREIGN PATENT DOCUMENTS

WO 2010129631 A1 11/2010
WO WO-2023113934 A1 * 6/2023 ..... E21B 34/14

OTHER PUBLICATIONS

Foreign Communication from Related Application—International Search Report and Written Opinion of the International Searching Authority, International Application No. PCT/US2022/052513, dated Aug. 28, 2023, 10 pages.
(Continued)

*Primary Examiner* — Giovanna Wright
(74) *Attorney, Agent, or Firm* — Conley Rose, P.C.; Rodney B. Carroll

(57) ABSTRACT

A downhole shifter tool assembly configured to operate a downhole tool. The shifter tool assembly comprises a anchor tool, an extension tool, a shifting key, and a standoff spacer. The standoff spacer is configured to locate the shifter tool assembly at a reference position by contacting an isolation member on the downhole tool. An anchoring mechanism within the anchor tool can anchor the shifter tool assembly in the reference position. An extend-retract mechanism within the extension tool can extend move the shifting key on a shifting tool into engagement with a shifting profile on the downhole tool and move the shifting profile to a second position. The downhole tool can be operated by the shifting key moving the shifting profile from an initial position to the second position.

24 Claims, 7 Drawing Sheets

(56) References Cited

U.S. PATENT DOCUMENTS

| | | | | |
|---|---|---|---|---|
| 2017/0370189 | A1* | 12/2017 | MacDougall | E21B 34/06 |
| 2019/0063185 | A1 | 2/2019 | Kshyk et al. | |
| 2020/0040679 | A1* | 2/2020 | Mauchien | E21B 23/01 |
| 2021/0189820 | A1* | 6/2021 | Baklanov | E21B 23/14 |
| 2023/0161316 | A1* | 5/2023 | Laplane | E21B 41/00 166/373 |

OTHER PUBLICATIONS

Mauchien, Thomas et al., "Inchworming After Tagging the Ball Proves an Efficient Method for Opening a Completion Isolation Valve with Electric-Line Powered Shifting Tool in Deepwater Gulf of Mexico: A Case Study," SPE/ICoTA Well Intervention Conference and Exhibition, Mar. 22-25, 2021, SPE-204413-MS, 9 pages, Society of Petroleum Engineers.

* cited by examiner

METHOD FOR OPENING A COMPLETION ISOLATION VALVE WITH E-LINE POWERED SHIFTING TOOL

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

During the preparation of oil and gas wells for the production of hydrocarbons it is common practice to include one or more valves within a string of pipe to separate one production zone from another or to isolate the wellbore from the hydrocarbon bearing formations. These valves can be referred to as completion valves and can be comprised of an isolation member and an activation mechanism. The isolation member of the completion valve can be a ball valve, a disc, a flapper, or a sleeve. The isolation member can be positioned into the open or closed position by a shifting tool engaging and moving the activation mechanism.

The shifting tool is deployed from surface into the wellbore to perform the shifting operation. The shifting tool must locate the activation mechanism, engage a shifting profile, and apply a predetermined amount of force to operate the completion valve. Locating the activation mechanism can be a time consuming process. In one scenario, the service personnel can search for the shifting profile by repeatedly lowering and raising the shifting tool through the completion valve. In another scenario, the service personnel can locate an extension mechanism within the wellbore and slowly move the shifting tool through the valve with the extension mechanism. These methods of locating the activation mechanism with the shifting tool can be time consuming and unreliable. A shifting tool that can quickly and reliably locate the activation mechanism is desirable.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Completion valves can comprise a primary actuation mechanism, a secondary actuation mechanism, and an isolation member. In some scenarios the primary actuation mechanism can be a hydraulic system or electro-mechanical system to operate the completion valve with a secondary actuation mechanism comprising a shiftable activation mechanism. In other scenarios the shiftable activation mechanism can be the primary actuation mechanism. The completion valves can be deployed on production tubing coupled to a downhole completion, for example, a gravel pack completion. The completion valves can be located within a downhole completion, for example, between production zones. The completion valves can be coupled to the casing proximate to a production zone.

Operating completion valves in the wellbore can be challenging. The location of the completion valve can be difficult to determine with a shifting tool suspended by a workstring from the surface. The activation mechanism of the completion valve can include a shifting profile commonly operated by wireline tools. These shifting profiles may be recessed out of the flow path which can increase the difficultly of locating the shifting profile with the shifting tool. The completion valve may need a predetermined amount of axial force to displace, activate, or otherwise position the actuation mechanism within the completion valve from an initial position to a second position to operate the completion valve.

To address some of the challenges described above, as well as others, apparatus, systems, and methods for locating and actuating an actuation mechanism of a completion valve with a shifting tool deployed on a workstring are described. Various embodiments include a shifting profile locating mechanism. This mechanism can place the profile of the shifting tool proximate to the shifting profile with greater accuracy. Various embodiments comprise an anchoring mechanism and an extension mechanism to anchor the shifting tool assembly to the inner surface of a wellbore tubular to apply a predetermined amount of axial force to operate the completion valve. Various example embodiments that can provide some or all of these advantages will now be described in detail.

Figure 1:
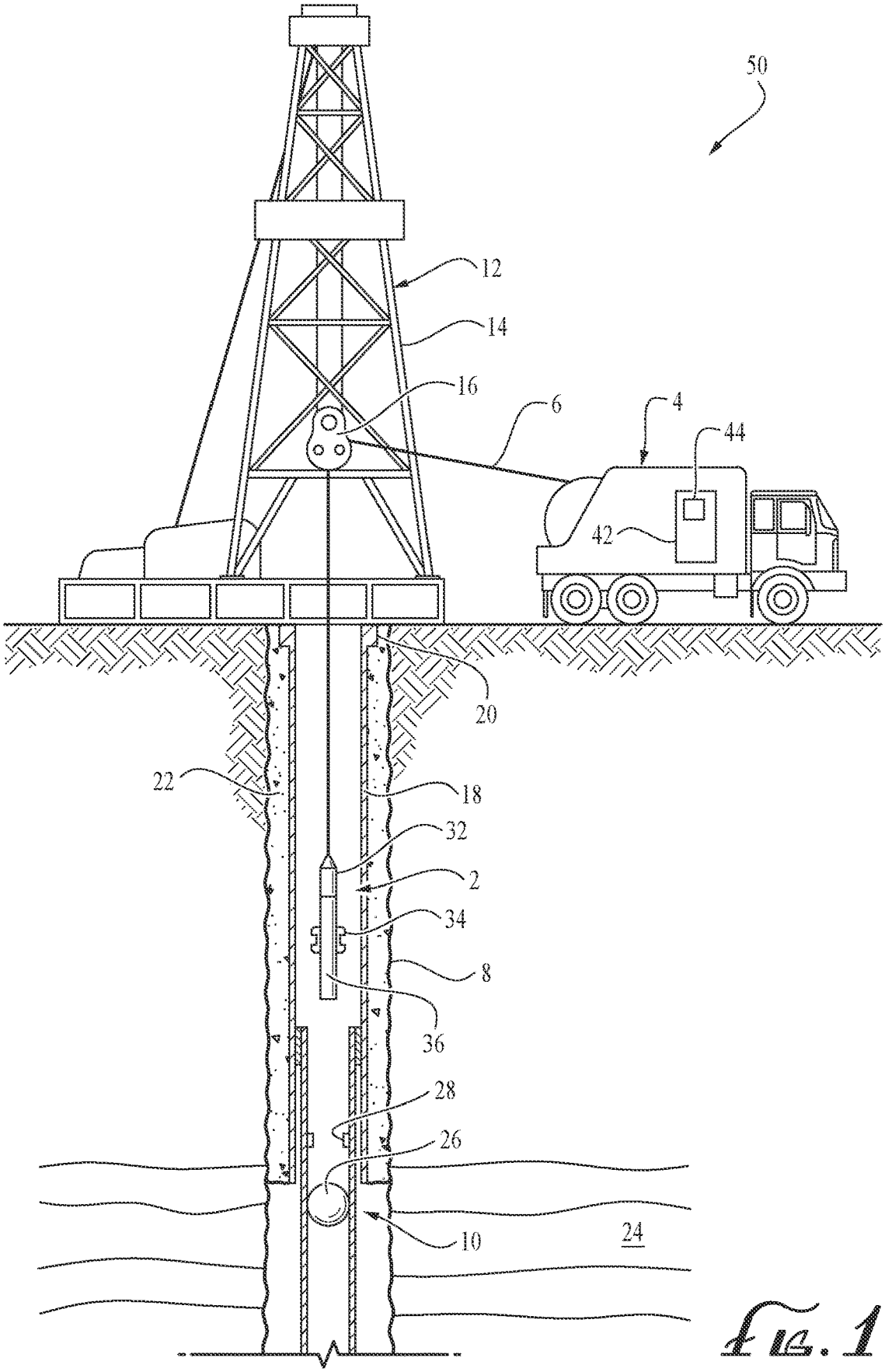
FIG. 1 is an illustration of a wireline operating environment at a wellsite according to an embodiment of the disclosure.

Turning now to FIG. 1, a wellbore servicing environment 50 is described. In an embodiment, a wireline shifting operation can comprise a wireline shifting tool assembly 2 communicatively coupled to a surface logging facility 4 by a workstring 6, for example, wireline or logging cable. Typically, a wireline shifting tool assembly 2, also referred to as a shifting assembly, is lowered into a wellbore 8 to operate a downhole tool of interest, e.g., a completion valve 10.

The wireline shifting operation can begin with transporting the surface logging facility 4, the shifting assembly 2, and various wireline equipment to a remote wellsite. The remote wellsite can on land (as illustrated in FIG. 1) or offshore. The remote wellsite can include various types of drilling rigs, workover rigs, wellheads, production equipment, production platforms, jack-up rigs, offshore rigs supported by floating structures, a drillship, or any similar operating environment.

The wireline shifting operation can be performed with a drilling or workover rig 12 comprising a derrick 14 and various wireline equipment 16 for the conveyance of the shifting assembly 2 into the wellbore 8. The wellbore 8 may include one or more casing string 18, e.g., pipes threadingly coupled together, and anchored at surface with a wellhead 20. The casing string 18 can be cemented 22 within the wellbore 8. For example, the wellbore 8 can comprise a casing string 18 supported by cement 22 extending into a formation 24. In some embodiments, the wellbore 8 can comprise a portion of the wellbore 8 without a casing string 18.

The wireline shifting operation comprises lowering the shifting assembly 2 to a target depth, e.g., the completion valve 10, and subsequently locating a shifting profile with the shifting assembly 2. The shifting assembly 2 comprises a wireline logging head 32, at least set of shifting keys 34, and a locating sub 36. The locating sub 36 of the shifting assembly 2 can contact the closed isolation device, e.g., ball valve 26. For example, the shifting assembly 2 can be lowered into the wellbore 8 approximate the completion valve 10 to slowly be lowered further to contact or tag the closed ball valve 26 of the completion valve 10. The set of shifting keys 34 within the shifting assembly 2 can be actuated from the surface logging facility 4, also referred to as a logging facility, via a processor within the wireline logging head 32. The wireline logging head may include one or more processors, memory, and a data acquisition process executing in memory to control the function of the shifting keys 34 and record periodic datasets indicative of the shifting operation. The periodic datasets can comprise measurement data from one or more sensors, such as accelerometers, and may be stored in memory or transmitted to surface via the logging cable 6. The measurement data can be communicated to the logging facility 4 for storage, processing, and analysis. The logging facility 4 may be provided with electronic equipment, e.g., computer system, for various types of signal processing.

Figure 2:
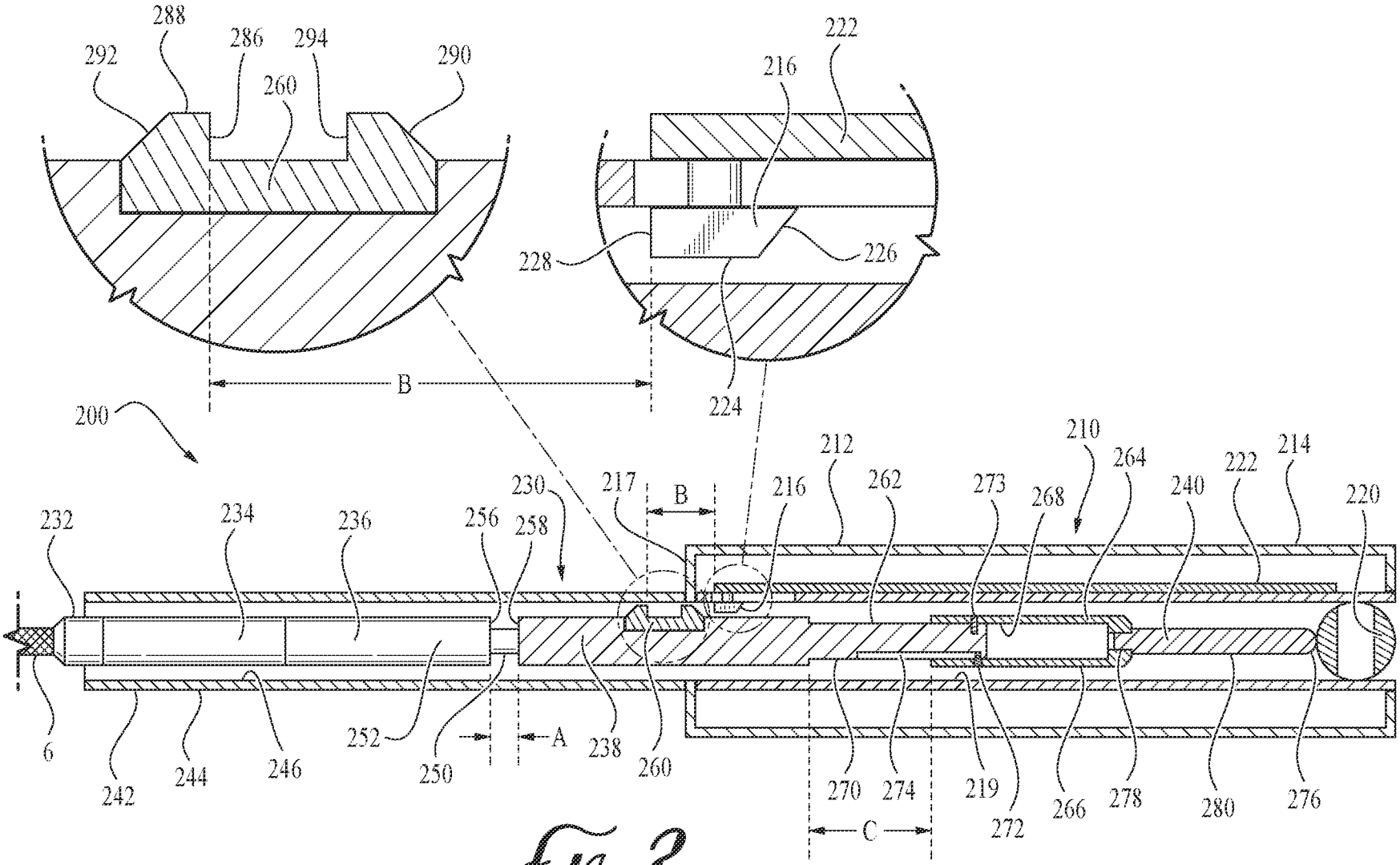
FIG. 2 is a side view of a downhole shifting tool assembly within a downhole tool according to an embodiment of the disclosure.

Turning now to FIG. 2, an embodiment of the wireline shifting tool assembly 2 is illustrated. For example, FIG. 2 illustrates a side view of a downhole shifting tool operation 200 with a downhole shifting tool assembly 230 within a completion valve 210. In some embodiments, the downhole shifting tool assembly 230, also referred to as the shifting assembly, comprises a cable head 232, an anchor tool 234, an actuator tool 236, a shifter tool 238, and a standoff spacer 240. The shifting assembly 230 can locate the completion valve 210 by contacting, also referred to as tagging, the isolation member of the completion valve 210. In some embodiments, the completion valve 210 can comprise a housing 212, a shifting profile 216, a mechanical linkage 222, and an isolation member 220, e.g., ball valve. The completion valve 210 can be mechanically coupled, e.g., threadingly coupled, to an oilfield tubular 242. The oilfield tubular 242 can be a casing string, e.g., casing string 18, a production tubing, a gravel pack extension, a completion housing, or any similar tubular. The oilfield tubular 242 can be generally cylindrical in shape with an outer surface 244, an inner surface 246, and can be coupled by a threaded coupling, for example, to the housing 212 of the completion valve 210.

In some embodiments, the completion valve 210 can further comprise a shifting profile 216 and a mechanical linkage 222 configured to mechanically couple the shifting profile 216 to the isolation member 220, e.g., ball valve. It is understood that the mechanical linkage 222 is illustrative of at least one component, a series of components, mechanisms, assemblies, or combinations thereof that mechanically couples the shifting profile 216 to the isolation member 220. The shifting profile 216 can be configured to operate the isolation member 220 from a first position, e.g., closed position, to a second position, e.g., open position, via the mechanical linkage 222. The housing 212 can be generally cylindrical in shape with an outer surface 214, an inner surface 219, and an end surface 217. The shifting profile 216 can be generally cylindrical in shape with an inner surface 224, an first end surface 228, and a second end surface 226. The first end surface 228 can be generally flat in profile and configured to engage the shifter key 260 of the shifter tool 238. The second end surface 226 can include an acute angle with respect to the longitudinal axis and be configured to not engage, also referred to as release, the shifter key 260. In some embodiments, the inner surface 224 of the shifting profile 216 can include features designed to selectively engage the shifting key of the shifting assembly 230. The shifting profile 216 can be located proximate to the end surface 217. Although the shifting profile 216 is illustrated at an opposite end to the isolation member 220, it is understood that the shifting profile 216 could be located 10%, 20%, 30%, 40%, 50%, 60%, 70%, 80%, 90% or anywhere within the range of 10% to 90% of the linear distance from the end surface 217 to the isolation member 220.

The shifting assembly 230 can electrically and mechanically couple to the workstring 6 via the cable head 232. The workstring 6 can include at least one conductor cable to convey electrical power and communication from the logging facility 4 to the various devices of the shifting assembly 230. The cable head can mechanically couple to the workstring 6 and electrically couple to the one or more conductor cables. The cable head 232 can electrically couple the logging facility 4 to the various mechanisms of the shifting assembly 230 via the workstring 6. Although the workstring 6 is described as a logging cable, it is understood that the workstring can be any braided wire or tubing with electrical conductors including wireline, coiled tubing, jointed pipe, hard-wired drill pipe, or any other suitable deployment technique.

In some embodiments, the cable head 232 comprises a controller and various sensors for measuring the wellbore environment. The controller can include at least one processor, a non-transitory memory, and one or more processes executing in memory. The cable head can receive periodic datasets indicative of the shifting operation and/or wellbore environment via sensor including pressure transducers, accelerometers, temperature sensors, acoustic sensors, and stress/strain sensors. For example, the cable head 232 can measure the wellbore pressure. In another scenario, the cable head 232 can measure a value of force applied by the shifting operation. The periodic datasets can be stored and/or transmitted to the logging facility 4 via the workstring 6.

An anchor tool 234 can be coupled to the cable head 232. The term "coupled to" is understood to mean "electrically and mechanically coupled to" when referring to the shifting assembly 230. The anchor tool 234 comprises a anchoring device comprising an anchoring slip or anchoring pad configured to grip, e.g., embed into, the inner surface 246 of the casing. In some embodiments, the anchoring slip can comprise teeth along the outer surface to engage or grip the inner surface of the tubular. The anchoring slip can be urged into engagement by one or two wedges, e.g. cone shaped parts. In some embodiments, an anchoring pad can be urged into engagement with the inner surface 246 of the oilfield tubular 242 by one or more arms as will be described further hereinafter.

An actuator tool 236 can be coupled to the anchor tool 234 comprising an extension housing 252, an extension mandrel 250, and an extension feature. The extension mandrel 250 can telescope or extend outward and return, or retract inward, from the extension housing 252. The extension mandrel 250 can be coupled to the extension housing 252 by the extension feature. The extension feature, also called the extend-retract mechanism, can be i) a hydraulic system with a volume of fluid and a pump, ii) a motor driven gear system, iii) a motor turning a threaded extension, iv) an electromagnetic extension feature, or v) combinations thereof. The extension feature can be communicatively coupled with the controller in the cable head 232 and/or a controller located within the logging facility 4. The controller can receive a command signal transmitted by the service personnel at surface via the logging facility 4. The extension mandrel 250 can be extended from a first position labeled "A" by the extension feature via control signals sent from the controller. The first position A can be the linear distance from end face 256 of the actuator tool 236 to the end face 258 of the shifter tool 238.

In some embodiments, the extension feature, via the controller, can extend and/or retract the extension mandrel 250. In some embodiments, the extension feature can comprise a first volume of fluid, a pump, and a second volume of fluid. The mandrel can be extended by transferring fluid from the first volume to the second volume by the pump. In some embodiments, the extension mandrel 250 can be extended by an electric motor turning a gearing system mechanically coupled to the extension mandrel 250. In some embodiments, the extension mandrel 250 can be a threaded rod that is extended/retracted from the extension housing 252 by an electric motor. In some embodiments, the extension mandrel 250 comprises a plurality of permanent magnets installed on the outer surface of the extension mandrel 250 and can extend and retract by a plurality of electromagnets installed within the extension housing 252.

A shifter tool 238 can be coupled to the extension mandrel 250 of the actuator tool 236. The shifter tool 238 comprises a set of shifter keys 260, an inner mandrel 262, and an outer housing 264. Each of the shifter keys 260 can include an outer surface 288, an engagement face 286, a front face 290, and a back face 292. The engagement face 286 can be configured to couple or mate the first end surface 228 of the shifting profile 216 of the completion valve 210. The front face 290 and back face 292 can include an angled surface, e.g., an acute angle relative to the longitudinal axis, configured to urge the shifter key 260 into the outer housing, for example, to release the shifting profile 216. The shifter keys 260 can be spring loaded and installed inside a key window in an outer housing. A set of springs coupled to the shifter key 260 can urge or bias the shifter keys 260 upwards through the key window and against the key housing or radially outwards relative to the longitudinal axis of the shifter tool 238. The key housing can retain the shifter keys 260 within the shifter tool 238. Although one shifter key 260 is illustrated, it is understood that the shifter tool 238 can have 1, 2, 3, 4, 5, 6, or any number of shifter keys 260. The one or more shifter keys 260 can be referred to as a set of shifter keys 260.

The shifter tool 238 can further comprise an inner mandrel 262 and outer housing 264. The outer housing 264 can be a generally cylinder shape with an outer surface 266 and an inner surface 268. The inner surface 268 can have a sliding fit with the outer surface 270 of the outer housing 264. The outer housing 264 can telescope or slide over the inner mandrel 262 from an initial distance labeled "C." The initial distance C can decrease in value during the operation of the shifter tool 238. The outer housing 264 can have a retainer screw 272 with a sliding fit inside a slot 274 on the inner mandrel 262. A shear pin 273 can retain the outer housing 264 in a first position in relation to the inner mandrel 262 and can be installed within a first port on the outer housing 264 and a second port on the inner mandrel 262.

A standoff spacer 240 can be coupled to the shifter tool 238. The standoff spacer 240 can be generally rod shaped with an outer surface 280, a contact face 276 and an end surface 278. The end surface can be mechanically coupled, e.g., threaded, with the outer housing 264. The contact face 276 can be configured to contact or tag the isolation member 220. The axial length from the contact face 276 to the end surface 278 can be configured to locate the shifter keys 260 of the shifter tool 238 within a target distance labeled "B" of the shifting profile 216 of the completion valve 210. The target distance B can decrease in value during the shifter tool 238 operation.

Figure 3:
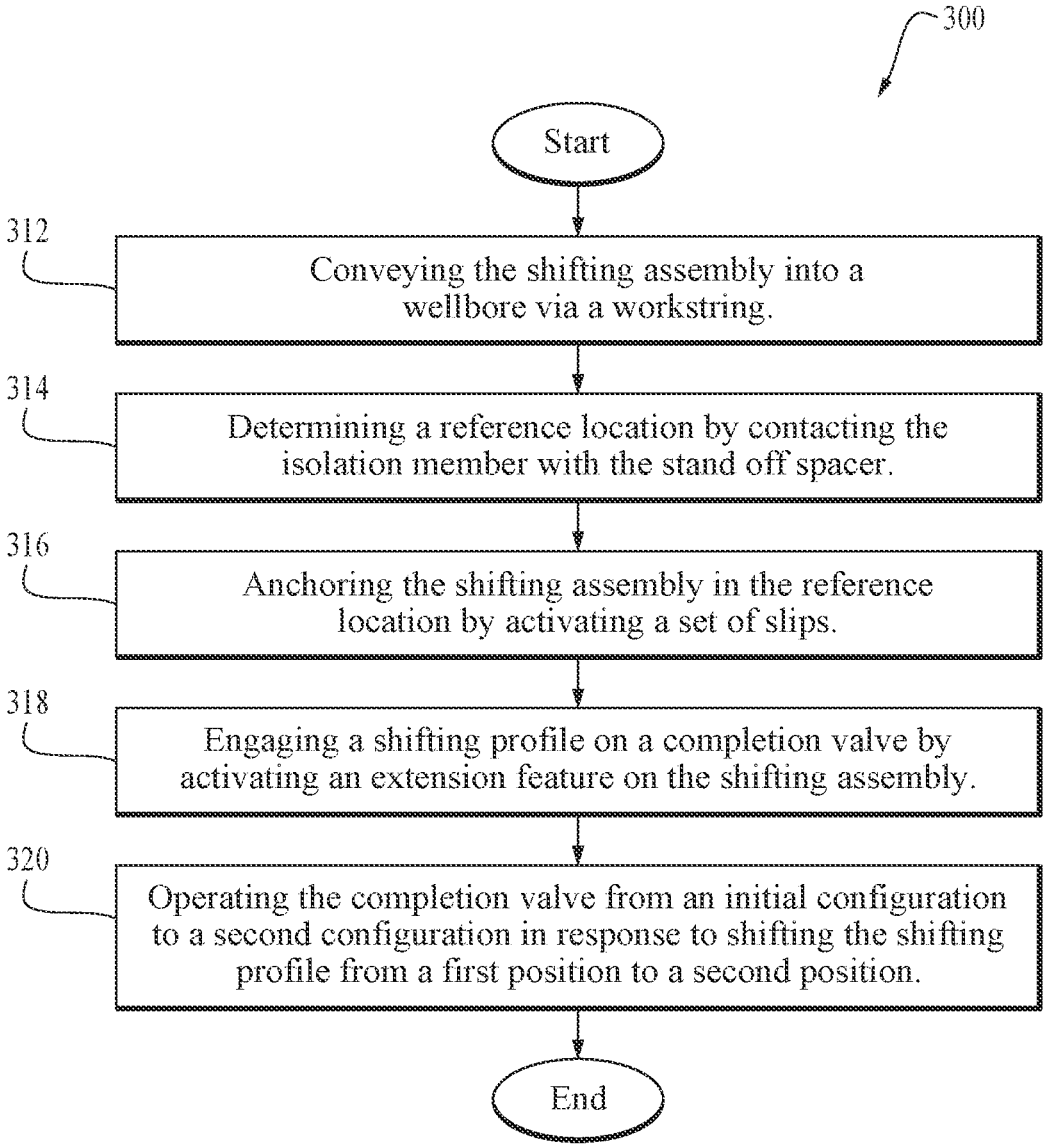
FIG. 3 is a logic block diagram of a method of operating a downhole tool according to an embodiment of the disclosure.

The wireline shifting operation with the shifting assembly 230 can be described. A method 300 of shifting a completion valve with a shifting assembly 230 is illustrated with logic block diagram in FIG. 3. At block 310, the shifting assembly 230 can be transported to a remote wellsite. At block 312, the shifting assembly 230 can be conveyed into the wellbore 8 on a workstring 6.

At block 314, the shifting assembly 230 can determine a reference location by contacting the isolation member 220. As shown in FIG. 2, the shifting assembly 230 can be lowered or conveyed into the completion valve 210 until the standoff spacer 240 contacts or tags the isolation member 220. The contact of the standoff spacer 240 to the isolation member 220 can establish a reference location for the service personnel within the logging facility 4 at surface. In some embodiments, the service personnel can determine the standoff spacer 240 is in contact with the isolation member 220 by sensors within the logging facility 4, for example, the weight of the shifting assembly 230 as measured by a weight indicator coupled to the workstring 6. In some embodiments, the service personnel can determine the standoff spacer 240 is in contact with the isolation member 220 by sensors within the cable head 232, for example, an accelerometer. The reference location determined by contacting the isolation member 220 can indicate that the shifter keys 260 of the shifter tool 238 are within a target distance labeled "B" of the shifting profile 216 of the completion valve 210. The target distance B can be measured from the engagement face 286 of the shifter key 260 to the first end surface 228 of the shifting profile 216 of the completion valve 210. In some embodiments, the length of the standoff spacer 240 in contact with the isolation member 220 can determine a reference location for the shifter keys 260 and the shifting assembly 230.

Figure 4:
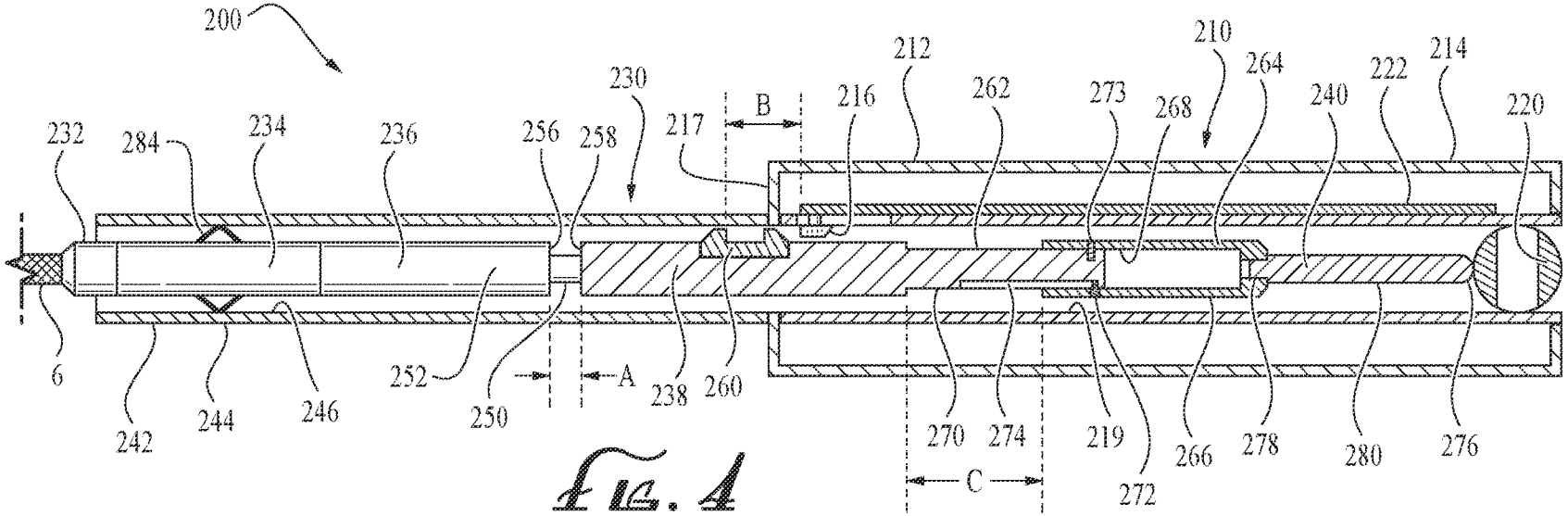
FIG. 4 is a side view of a downhole shifting tool assembly anchored to an oilfield tubular according to an embodiment of the disclosure.

At block 316, the shifting assembly 230 can anchor at the reference location by activating a set of slips. Turning now to FIG. 4, an illustration of a side view of a downhole shifting tool operation 200 can be described. An anchoring device 284, e.g., a set of anchoring devices, can be extended from the anchor tool 234 to contact and grip the inner surface 246 of the tubular 242. The set of anchoring devices 284 can comprise a pad with teeth along the outer surface, an upper arm, and a lower arm and can be extended outward from the anchor tool 234. The anchor tool 234 can comprise 1, 2, 3, 4, 5, 6, 7, 8, or more anchoring devices which can be referred to as a set of anchoring devices 284. The anchor tool 234 can utilize mechanical force or hydraulic force to actuate the set of anchoring devices 284. For example, the anchor tool 234 can utilize electrical power from the workstring 6 via the cable head 232 to actuate an electrical motor to turn a screw to compress or move a first arm towards a second arm to extend the pad outwards towards the inner surface 246 of the tubular 242. In another scenario, an electric motor can actuate a pump to supply hydraulic fluid into a piston chamber to drive a first arm towards a second arm to extend the pad outwards towards the inner surface 246 of the tubular 242. Sensors within the anchor tool 234 can provide feedback to the service personnel at surface via communication to the logging facility 4. For example, periodic datasets from a positional sensors coupled to one or more arms can be transmitted to surface. In some embodiments, the service personnel at surface may apply tension on the workstring 6 via the logging facility 4 to verify the anchor tool 234 is anchoring the shifting assembly 230 at the reference location within the tubular 242 with the set of anchoring devices 284 gripping the tubular 242.

Figure 5:
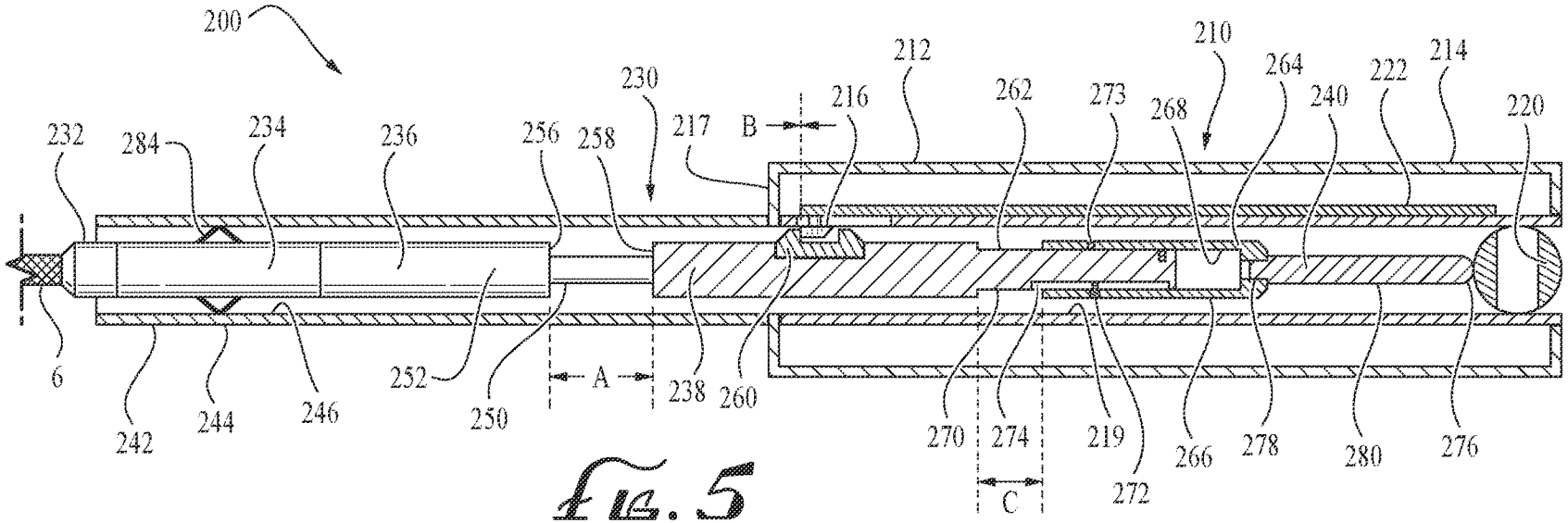
FIG. 5 is a side view of a downhole shifting tool assembly engaging a shifting profile of a downhole tool according to an embodiment of the disclosure.

At block 318, the shifting assembly 230 can engage a shifting profile on a completion valve by activating an extension feature on the shifting assembly. Turning now to FIG. 5, the anchoring assembly 230 can be in contact with the isolation member 220 via the standoff spacer 240 and anchored to the tubular 242 via the set of anchoring devices 284. The actuator tool 236 can urge or move the shifter key 260 of the shifter tool 238 forward, e.g., towards the shifting profile 216, by extending the extension mandrel 250 from the extension housing 252 via the extension feature. The extension feature can receive electrical power and communication from the unit controller within the cable head 232 and/or the logging facility 4 to extend the extension mandrel 250 from the extension housing 252 via at least one of the extension methods previously described. The initial movement of the extension mandrel 250 outwards from the extension housing 252 can generate a compression loading onto the isolation member via the standoff spacer 240 until the shear pin 273 breaks at a predetermined value to allow the outer housing 264 to move or telescope over the inner mandrel 262 of the shifter tool 238. As the extension mandrel 250 continues to extend from the extension housing 252, the distance between the actuator tool 236 and shifter tool 238 with the label A increases as the distance between the outer housing 264 and inner mandrel 262 of the shifter tool 238 labeled C decreases until the target distance labeled B reaches zero and the shifter keys 260 engage the shifting profile 216 of the completion valve 210.

Figure 6:
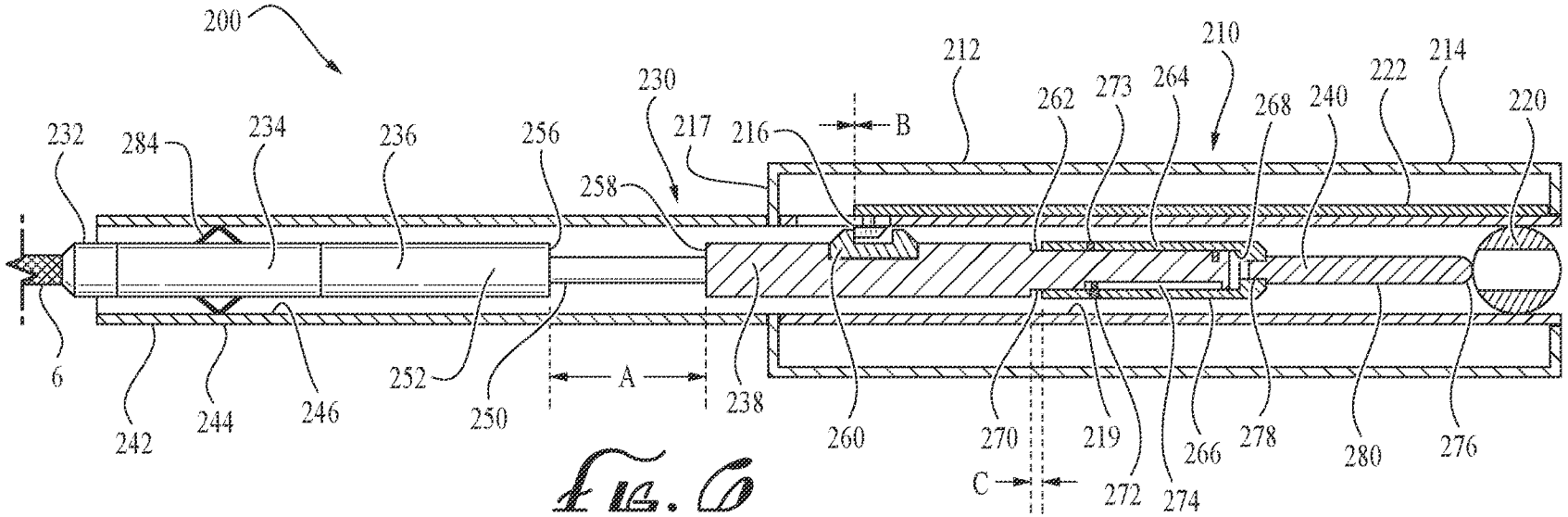
FIG. 6 is a side view of a downhole shifting tool assembly operating a downhole tool according to an embodiment of the disclosure.
Figure 7:
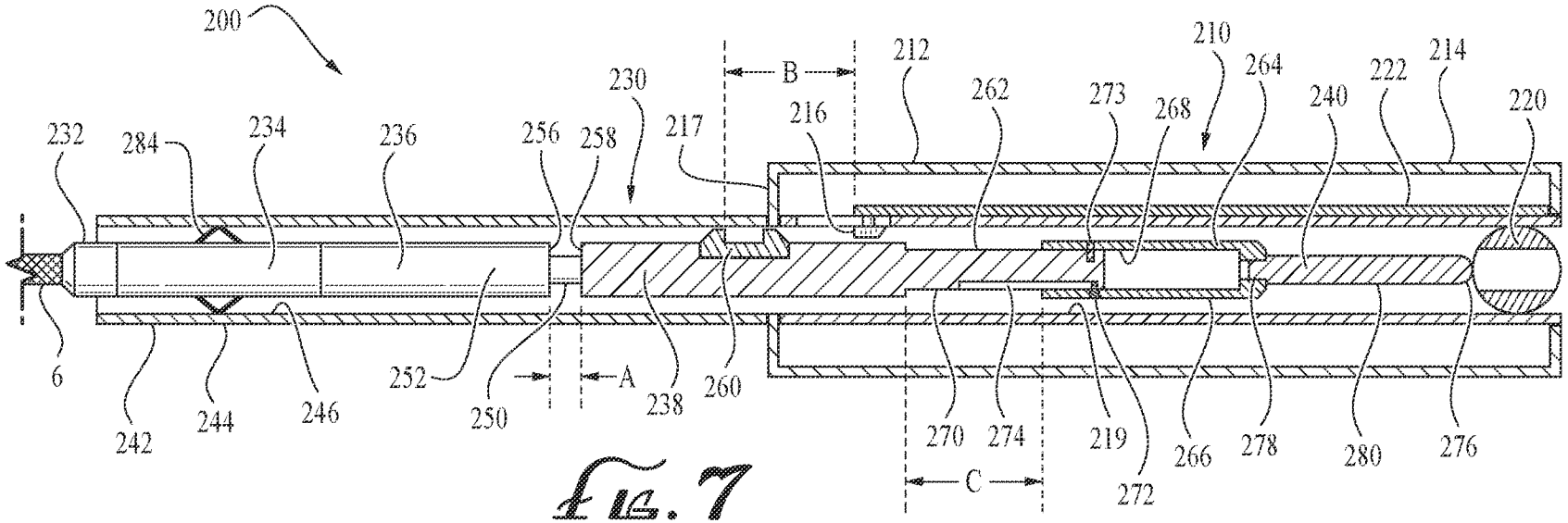
FIG. 7 is a side view of a downhole shifting tool assembly releasing from a downhole tool according to an embodiment of the disclosure.

At block 320, the shifting assembly 230 can operate the completion valve from an initial configuration to a second configuration in response to moving the shifting profile from a first position to a second position. Turning now to FIG. 6, the shifting assembly 230 can move or displace the shifting profile 216 from a first position to a second position by extending the extension mandrel 250 and increase the value of the distance labeled A. The displacement of the shifting profile 216 to the second position can activate or configure the isolation member 220 from a first configuration, e.g., closed position, to a second configuration, e.g., open position, via the mechanical linkage 222. In some embodiments, an actuation mechanism of the isolation member 220, e.g., opening mechanism, can be mechanically coupled to the shifting profile 216 via a mechanical linkage 222.

In some embodiments, the extension feature of the actuator tool 236 can return or retract the extension mandrel 250 to an initial position, e.g., distance A of FIG. 2, via the extension mechanism. For example, the electric motor can turn a threaded member an opposite direction than was used to extend the threaded member. The shifter key 260 of the shifter tool 238 can release or disengage from the shifting profile 216 of the completion valve 210. For example, the shifter tool 238 moving away from the shifting profile 216 can release or disengage the face 286 of the shifter key 260 from the end surface 228 of the shifting profile 216. The shifter key 260 can be depressed into the key window of the outer housing by the second face 294 of the shifter key 260 engaging the end surface 226 of the shifting profile 216 as the shifter key 260 travels past the shifting profile 216. The outer housing 264 of the shifter tool 238 can telescope outwards and the distance labeled C can return to the distance shown in FIG. 2. The retainer screw 272 within the outer housing 264 can retain the outer housing 264 at the distance labeled C by remaining within the slot 274 of the inner mandrel 262.

In some embodiments, the anchoring device 284 of the anchor tool 234 can release the shifting assembly 230 from the reference location within the tubular 242. Although the method 300 of the wireline shifting operation describes the release of the anchoring device 284, e.g., slips, after the retraction of the extension mandrel 250 of the actuator tool 236, it is understood that the step of releasing the anchoring device 284, e.g., slips, can occur before retraction, simultaneously to retraction, or nearly simultaneously to retraction of the mandrel of the actuator tool 236 and/or releasing of the shifter key 260 from the shifting profile 216.

Figure 8:
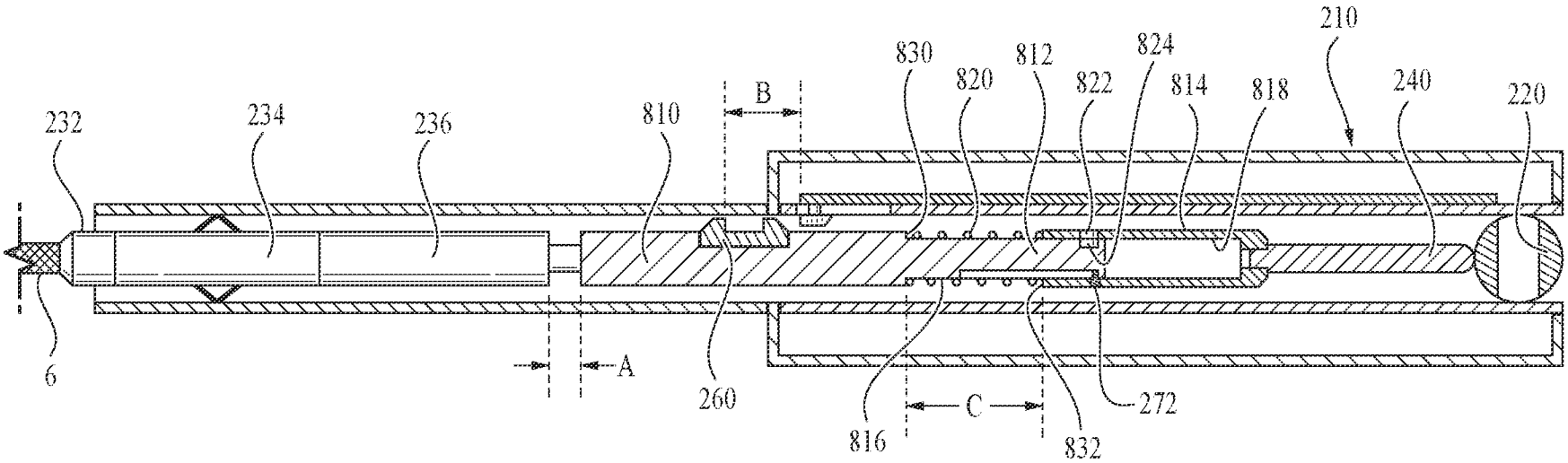
FIG. 8 is a side view of a releasing assembly for a resettable downhole shifting tool assembly according to an embodiment of the disclosure.
Figure 9A:
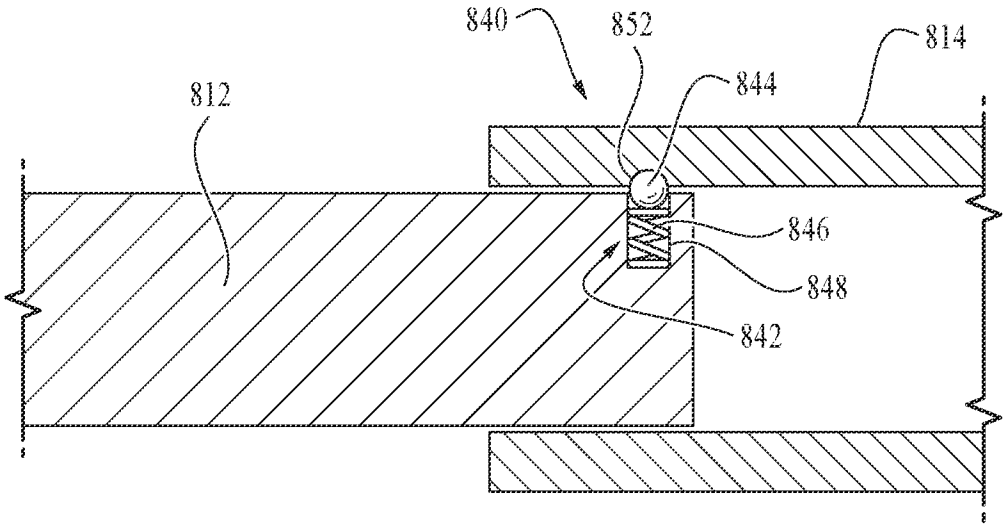
FIGS. 9A and 9B are side views of of a downhole shifting tool assembly within a downhole tool according to an embodiment of the disclosure.
Figure 9B:
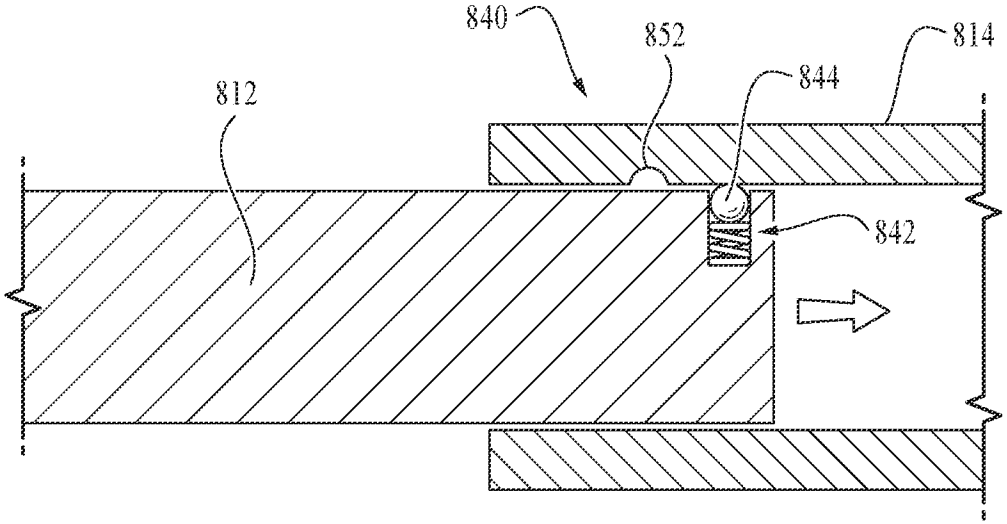

In some embodiments, the shifter tool may return to an initial or run-in condition. Turning now to FIG. 8, the anchoring assembly 230 can comprise a shifter tool 810 with a return spring 820. The outer housing 814 of the shifter tool 810 can be generally cylindrical in shape with an outer surface and an inner surface 818. The inner surface 818 of the outer housing 814 can have a sliding fit over an outer surface 816 of an inner mandrel 812. A return spring 820 can be installed over the outer surface 816 of the inner mandrel 812 and located between a lower face 830 on the shifter tool 810 and an upper face 832 on the outer housing 814. The return spring 820 can bias the outer housing 814 into an initial position, e.g., a run-in position.

A housing retainer 840 can retain the outer housing 814 relative to the inner mandrel 812 in an initial position, e.g., a run-in position. In some embodiments, the housing retainer 840 can comprise an outer magnet 822 coupled to the outer housing 814 and an inner magnet 824 coupled to the inner mandrel 812. The outer magnet 822 and inner magnet 824 can be made of any permanent magnet material, for example, neodymium-iron-boron, samarium-cobalt. Alnico, strontium ferrite, or other permanent magnet materials. The housing retainer 840 can disengage in response to a predetermined amount of axial force. The magnet flux, e.g., attraction, between the outer magnet 822 and the inner magnet 824 can retain the outer housing 814 and inner mandrel 812 in an initial position until a predetermined amount of force is applied, via the standoff spacer 240, to overcome the magnetic flux and/or separate the pair of magnets. The housing retainer 840 can re-engage in response to the outer housing 814 returning to the initial position and aligning the pair of magnets, e.g., the outer magnet 822 and inner magnet 824. Although a single set of magnets are illustrated, it is understood that the housing retainer 840 can comprise 1, 2, 3, 4, 5, 6, 7, 8, 9, 10, or any number of pairs of inner magnet 824 and outer magnet 822.

In some embodiments, the housing retainer 840 can comprise a releasing assembly 842 engaged with the outer housing 814. The releasing assembly 842 comprises a detent ball 844 and a detent spring 846 within a retaining port 848 on the inner mandrel 812. The detent ball 844 can be bias upwards into engagement with a retention groove 852 on the outer housing 814. The housing retainer 840 can disengage or release the outer housing 814 in response to a predetermined amount of axial force applied to the outer housing 814. The axial force applied the outer housing 814 can translate to a radial force applied to the detent ball 844 via the retention groove 852. The radial force can overcome the force or bias of the detent spring 846 to depress the detent ball 844 into the port 848 and out of engagement with the retention groove 852. The housing retainer 840 can re-engage in response to the outer housing 814 returning to the initial position and aligning the releasing assembly 842, e.g., the detent ball 844 with the retention groove 852. Although a single releasing assembly 842 is illustrated, it is understood that the housing retainer 840 can comprise 1, 2, 3, 4, 5, 6, 7, 8, 9, 10, or any number of releasing assemblies 842.

ADDITIONAL DISCLOSURE

The following are non-limiting, specific embodiments in accordance with the present disclosure:

A first embodiment, which is a downhole shifter assembly, comprising: a cable head electrically and mechanically coupled to a workstring; an anchor tool coupled to the cable head, wherein the anchor tool is configured to anchor the downhole shifter assembly to an oilfield tubular; an actuator tool coupled to the anchor tool, wherein the actuator tool comprises an extension feature configured to extend and retract a shifter tool of the downhole shifter assembly; a shifting key of the shifter tool configured to engage a shifting profile, wherein the shifter tool is coupled to the actuator tool; a standoff spacer coupled to the shifter tool; and a controller electrically coupled to the cable head configured to extend the actuator tool to move the shifting profile from a first position to a second position while the shifting profile is coupled to the at least one shifting key of the shifter tool.

A second embodiment, which is the downhole shifter assembly of the first embodiment, wherein the anchor tool comprises a first electrical motor coupled to an anchoring mechanism; wherein the anchoring mechanism comprises i) a set of slips and wedge or ii) a set of anchoring arms; and wherein the first electrical motor is electrically coupled to the cable head.

A third embodiment, which is the downhole shifter assembly of the first or second embodiment, wherein the actuator tool further comprises an extension mandrel and an extension housing, wherein the extension mandrel is coupled to the extension housing by the extension feature.

A fourth embodiment, which is the downhole shifter assembly of any of the first through the third embodiments, wherein the extension feature is one of i) a hydraulic system with a volume of fluid and a pump, ii) a motor-driving a gear system, or iii) a motor turning a threaded extension.

A fifth embodiment, which is the downhole shifter assembly of any of the first through the fourth embodiments, wherein the at least one shifting key is configured to engage a shifting profile in a first direction and release the shifting profile in a second direction, wherein the extension feature of the actuator tool is configured to move the shifting key in the first direction by extending an extension mandrel.

A sixth embodiment, which is the downhole shifter assembly of any of the first through the fifth embodiments, wherein the standoff spacer is configured to establish a reference location by contacting an isolation member of a downhole tool.

A seventh embodiment, which is the downhole shifter assembly of any of the first through the sixth embodiments, wherein the anchor tool is configured to anchor the downhole shifting assembly in the reference location with an anchoring mechanism.

An eighth embodiment, which is the downhole shifter assembly of any of the first through the seventh embodiments, wherein the actuator tool is configured to extend the at least one shifting key of the shifter tool to engage and shift a shifting profile of a downhole tool from a first position to a second position from the reference location.

A ninth embodiment, which is the downhole shifter assembly of any of the first through the eighth embodiments, further comprising at least one sensor configured to provide periodic datasets of an axial position of the extension feature to the controller.

A tenth embodiment, which is the downhole shifter assembly of any of the first through the ninth embodiments, wherein the controller is communicatively coupled to a first electric motor in the anchor tool, wherein the controller is communicatively coupled to a second electric motor coupled to the extension feature, and wherein the controller receives periodic datasets from at least one sensor coupled to the extension feature.

An eleventh embodiment, which is a method of operating a completion valve within a wellbore penetrating a formation, comprising conveying a shifting assembly into the wellbore on a workstring, wherein the shifting assembly comprises an anchor tool, an extension tool, a shifter tool, and standoff spacer; determining a reference location by contacting an isolation member of a downhole tool with the standoff spacer of the shifting assembly; anchoring the shifting assembly in the reference location by extending a set of slips within the anchor tool to grip an inner surface of an oilfield tubular; engaging a shifting profile on a downhole tool with at least one shifting key on the shifter tool by activating an extension feature within an extension tool; and operating the downhole tool from an initial configuration to a second configuration in response to shifting the shifting profile of the downhole tool from a first position to a second position.

A twelfth embodiment, which is the method of the eleventh embodiment, wherein the anchor tool further comprises an electric motor electrically coupled to a power source at surface, and wherein the set of slips are extended by the electric motor.

A thirteenth embodiment, which is the method of any of the eleventh and the twelfth embodiments, wherein the extension tool comprises an electric motor, an extension housing, and an extension mandrel; wherein the extension mandrel is coupled to the extension housing by the extension feature; and wherein the electric motor is electrically coupled to a power source at surface and configured to extend or retract the extension feature.

A fourteenth embodiment, which is the method of any of the eleventh through the thirteenth embodiments, wherein the shifting tool is moved from an initial position to engage the shifting profile on the downhole tool and move the shifting profile from a first position to a second position via the extension feature on the extension tool.

A fifteenth embodiment, which is the method of any of the eleventh through the fourteenth embodiments, further comprising transporting the shifting assembly to a wellsite.

A sixteenth embodiment, which is a system of a shifting tool assembly, comprising a surface logging facility; an anchor tool coupled to the surface logging facility by a workstring; an extension tool coupled to the anchor tool; a shifter tool coupled to the extension tool; an offset mandrel coupled to the shifter tool; a first electric motor coupled to a set of anchoring arms within the anchor tool; a second electric motor coupled to an extend-retract mechanism within the extension tool, wherein extend-retract mechanism is configured to increase or decrease an axial length of the extension tool; at least one sensor providing periodic datasets of the extend-retract mechanism; a controller comprising a processor and a non-transitory memory communicatively coupled to the surface logging facility, configured to: extend the set of anchoring arms to grip an inner surface of a wellbore tubular; extend the extend-retract mechanism to engage a shifting profile on a downhole tool with a shifting key on the shifter tool; and operate a downhole tool by shifting a shifting profile from an initial position to a second position via the extend-retract mechanism.

A seventeenth embodiment, which is the system of the sixteenth embodiment, further comprising a standoff spacer coupled to the shifter tool configured to establish a reference position, wherein the reference position is a distance from the shifting key of the shifter tool to a shifting profile on the downhole tool.

An eighteenth embodiment, which is the system of the sixteenth embodiment, wherein the at least one sensor is a positioning sensor, a stress/strain sensor, or both.

A nineteenth embodiment, which is the system of the sixteenth embodiment, wherein the set of anchoring arms comprise a first arm, a second arm, and a gripping pad.

A twentieth embodiment, which is the system of any of the sixteenth through the nineteenth embodiments, wherein the downhole tool is a completion valve.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the embodiments of the present disclosure. The discussion of a reference herein is not an admission that it is prior art, especially any reference that may have a publication date after the priority date of this application. The disclosures of all patents, patent applications, and publications cited herein are hereby incorporated by reference, to the extent that they provide exemplary, procedural, or other details supplementary to those set forth herein.

What is claimed is:

1. A shifter assembly, comprising:

a shifter tool comprising a shifting key configured to engage a shifting profile;

a cable head electrically and mechanically coupled to a workstring;

an anchor tool coupled to the cable head, wherein the anchor tool is configured to anchor the shifter assembly to an oilfield tubular;

an actuator tool coupled to the anchor tool and the shifter tool, wherein the actuator tool comprises an extension feature configured to extend and retract the shifter tool;

a standoff spacer coupled to an outer housing configured to slide over the shifter tool; and a controller configured to control the actuator tool to move the shifting profile from a first position to a second position while the shifting profile is coupled to the shifting key.

2. The shifter assembly of claim 1, wherein:

the anchor tool comprises a first electrical motor coupled to an anchoring mechanism;

the anchoring mechanism comprises a set of slips and wedge or a set of anchoring arms; and the first electrical motor is electrically coupled to the cable head.

3. The shifter assembly of claim 1, wherein:

the actuator tool further comprises an extension mandrel and an extension housing, and the extension mandrel is coupled to the extension housing by the extension feature.

4. The shifter assembly of claim 3, wherein the extension feature comprises a hydraulic system and a pump, a motor-driving a gear system, or a motor configured to turn a threaded extension.

5. The shifter assembly of claim 1, wherein the shifting key is further configured to engage the shifting profile in a first direction and release the shifting profile in a second direction, and the extension feature is further configured to move the shifting key in the first direction by extending an extension mandrel.

6. The shifter assembly of claim 1, wherein the standoff spacer is configured to contact an isolation member of a downhole tool.

7. The shifter assembly of claim 6, wherein the anchor tool is further configured to anchor the shifting assembly using an anchoring mechanism.

8. The shifter assembly of claim 6, wherein the actuator tool is configured to extend the shifting key to engage and shift the shifting profile.

9. The shifter assembly of claim 1, further comprising at least one sensor configured to transmit periodic datasets of an axial position of the extension feature to the controller.

10. The shifter assembly of claim 1, wherein the controller is communicatively coupled to a first electric motor in the anchor tool, the controller is communicatively coupled to a second electric motor coupled to the extension feature, and the controller is further configured to receive periodic datasets from at least one sensor coupled to the extension feature.

11. A method of operating a completion valve within a wellbore penetrating a formation, comprising:

conveying a shifting assembly into the wellbore on a workstring, wherein the shifting assembly comprises an anchor tool, an extension tool, a shifter tool, and a standoff spacer coupled to an outer housing configured to slide over the shifter tool;

determining a reference location by contacting an isolation member of a downhole tool with the standoff spacer;

anchoring the shifting assembly in the reference location by extending a set of slips within the anchor tool to grip an inner surface of an oilfield tubular;

engaging a shifting profile on the downhole tool with a shifter key on the shifter tool by activating an extension feature within the extension tool; and transitioning the downhole tool from a first configuration to a second configuration, in response to shifting the shifting profile from a first position to a second position.

12. The method of claim 11, wherein:

the anchor tool further comprises an electric motor electrically coupled to a power source at surface, and the set of slips are configured to be extended by the electric motor.

13. The method of claim 11, wherein:

the extension tool comprises an electric motor, an extension housing, and an extension mandrel;

the extension mandrel is coupled to the extension housing by the extension feature; and the electric motor is electrically coupled to a power source at surface and is configured to extend or retract the extension feature.

14. The method of claim 11, wherein:

the shifting tool is configured to engage the shifting profile on the downhole tool and move the shifting profile from the first position to the second position via the extension feature.

15. The method of claim 11, further comprising transporting the shifting assembly to a wellsite.

16. The method of claim 11, further comprising determining that the shifter tool and the shifter key are within a target distance based on the reference location.

17. The method of claim 16, further comprising extending the extension tool to position the shifter key to engage the shifting profile, based on the determined reference location.

18. A system for performing a shifting operation, comprising:

an anchor tool coupled to a workstring;

an extension tool coupled to the anchor tool;

a shifter tool coupled to the extension tool;

a standoff spacer coupled to an outer housing configured to slide over the shifter tool;

a first electric motor coupled to a set of anchoring arms within the anchor tool;

a second electric motor coupled to an extend-retract mechanism within the extension tool, wherein the extend-retract mechanism is configured to increase or decrease an axial length of the extension tool; and a controller configured to:

control the set of anchoring arms to grip an inner surface of a wellbore tubular;

control the extend-retract mechanism to engage a shifting profile on a downhole tool with a shifting key on the shifter tool; and control the downhole tool by shifting the shifting profile from a first position to a second position via the extend-retract mechanism.

19. The system of claim 18, wherein the standoff spacer is coupled to the shifter tool.

20. The system of claim 17, wherein the shifter tool is configured to establish a reference position, and the reference position is a distance from the shifting key to the shifting profile.

21. The system of claim 18, further comprising a sensor configured to transmit position data, stress data, or strain data of the extend-retract mechanism to the controller.

22. The system of claim 18, wherein the set of anchoring arms comprises a first arm, a second arm, and a gripping pad.

23. The system of claim 18, wherein the downhole tool comprises a completion valve.

24. The system of claim 18, further comprising:

an extension mandrel disposed between the actuator tool and the shifter tool.

* * * * *